US010336120B2

(12) United States Patent
Caneer

(10) Patent No.: US 10,336,120 B2
(45) Date of Patent: Jul. 2, 2019

(54) RIGID PROTECTION COVER AND CLOSURE

(71) Applicant: Gregory Caneer, Oakland, CA (US)

(72) Inventor: Gregory Caneer, Oakland, CA (US)

( * ) Notice: Subject to any disclaimer, the term of this patent is extended or adjusted under 35 U.S.C. 154(b) by 0 days.

(21) Appl. No.: 15/905,712

(22) Filed: Feb. 26, 2018

(65) Prior Publication Data

US 2018/0244096 A1 Aug. 30, 2018

Related U.S. Application Data

(60) Provisional application No. 62/463,611, filed on Feb. 25, 2017.

(51) Int. Cl.
*B42D 3/04* (2006.01)

(52) U.S. Cl.
CPC ..... *B42D 3/045* (2013.01); *B42P 2241/02* (2013.01); *B42P 2241/20* (2013.01)

(58) Field of Classification Search
CPC . B42D 3/045; B42D 2241/02; B42D 2241/20
See application file for complete search history.

(56) References Cited

U.S. PATENT DOCUMENTS 4,793,633 A * 12/1988 Rose, Jr. ..... B42D 3/045 206/472
2004/0079792 A1* 4/2004 Shapiro ..... A45C 3/02 229/67.1
2014/0001741 A1* 1/2014 Wang ..... B42D 3/045 281/45
2015/0008661 A1* 1/2015 Pencak ..... B42D 3/045 281/45

* cited by examiner

*Primary Examiner* — David R Dunn
*Assistant Examiner* — Christopher E Veraa
(74) *Attorney, Agent, or Firm* — Wooshik Shim; John D. Houvener; Bold Patents, PLLC

(57) ABSTRACT

Embodiments for a rigid protective cover and closure are provided. The rigid protective cover and closure includes an edge frame with a pull bar, spine insert, connector arms with connector ends, wherein the connector ends define an extend aperture, wherein the connector ends each include a pivot tab, a slide peg, a spring housing, and a spring band. Generally speaking, these components are structured such that pivot tabs of the connector ends are fastened to the spine insert.

12 Claims, 4 Drawing Sheets

RIGID PROTECTION COVER AND CLOSURE

CROSS-REFERENCE TO RELATED APPLICATIONS

This application claims priority to U.S. Provisional Application No. 62/463,611 filed, Feb. 25, 2017. The content of the above application is hereby expressly incorporated by reference herein in its entirety.

FIELD OF THE DISCLOSURE

This disclosure relates generally to the field of protective covers. More specifically, this disclosure relates to a rigid protection cover and closure.

BACKGROUND

Currently there are a number of solutions for protective covers for books, notebooks, sketchbooks, notepads, and similar items. Some solutions incorporate cover sleeves to protect the front and back covers as well as the binding of a book. The sleeves are sometimes made from paper, plastic, or metal. Some solutions feature a full coverage sleeves that have zip fasteners to fully envelop a bound book including hardcover and paperback books, notebooks, or sketchbooks. Other solutions incorporate elastic bands attached to the cover of a book and used to keep both covers closed while keeping the edges of the book exposed.

SUMMARY

The disclosure presented herein relates to a protection cover featuring an edge frame with a pull bar, a plurality of connector arms, and a spine insert. Each of the plurality of connector arms comprise a connector end with each connector end defining an extended aperture. Each connector end also include a pivot tab, a slide peg, a spring housing, and a spring band. Each pivot tab is attached to the slide peg and each slide peg is inserted within the extended aperture defined by each connector end. Further, each spring housing is attached to a connector end and each pivot tab is fastened to the spine insert.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

In the Summary above, this Detailed Description, the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range having a lower limit and an upper limit corresponding to the first number and the second number, respectively. For example, 25 to 100 mm means a range whose lower limit is 25 mm and upper limit is 100 mm.

Figure 1:
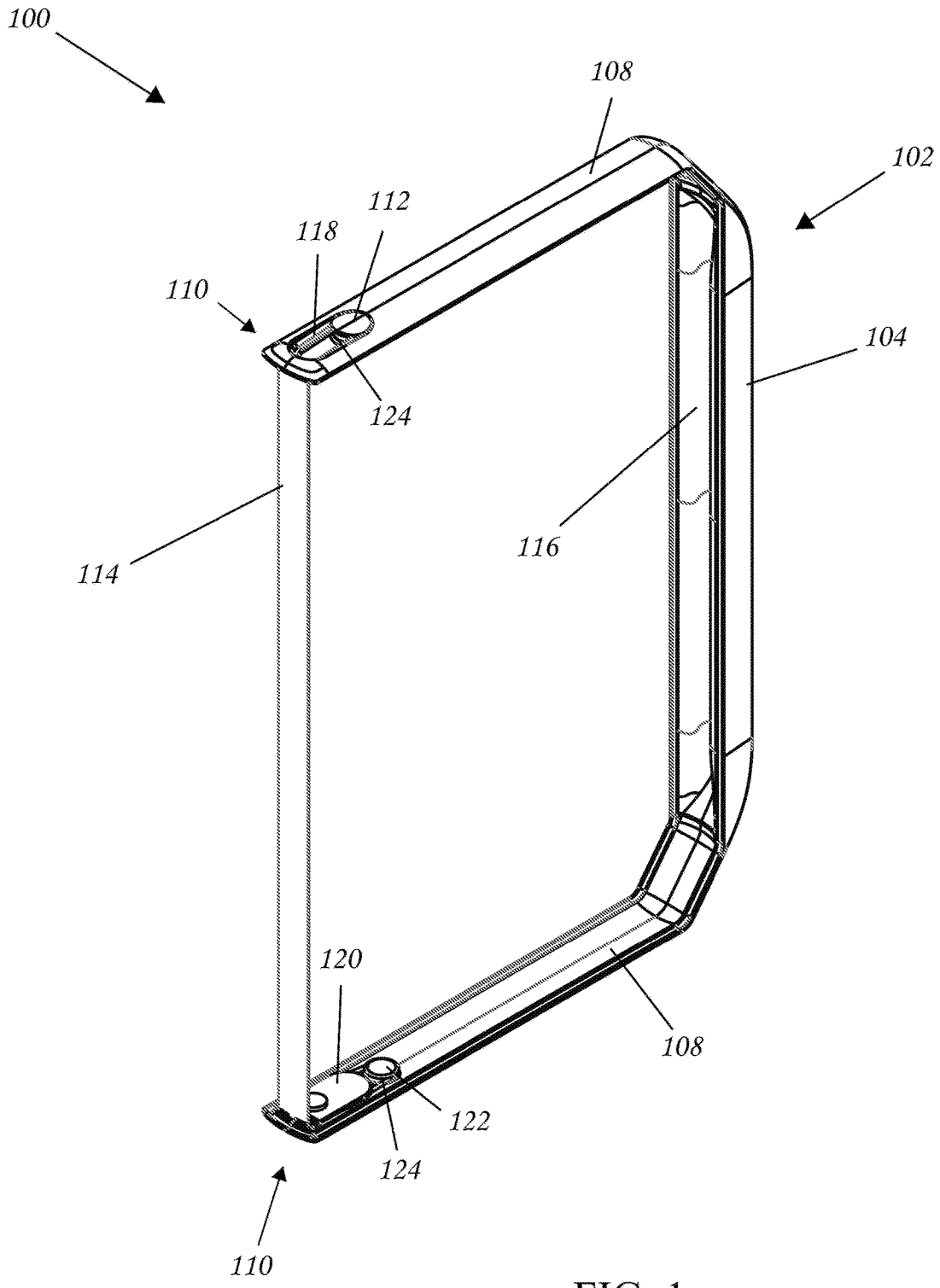
FIG. 1 is a perspective view depicting the protective cover according to one embodiment.
Figure 2:
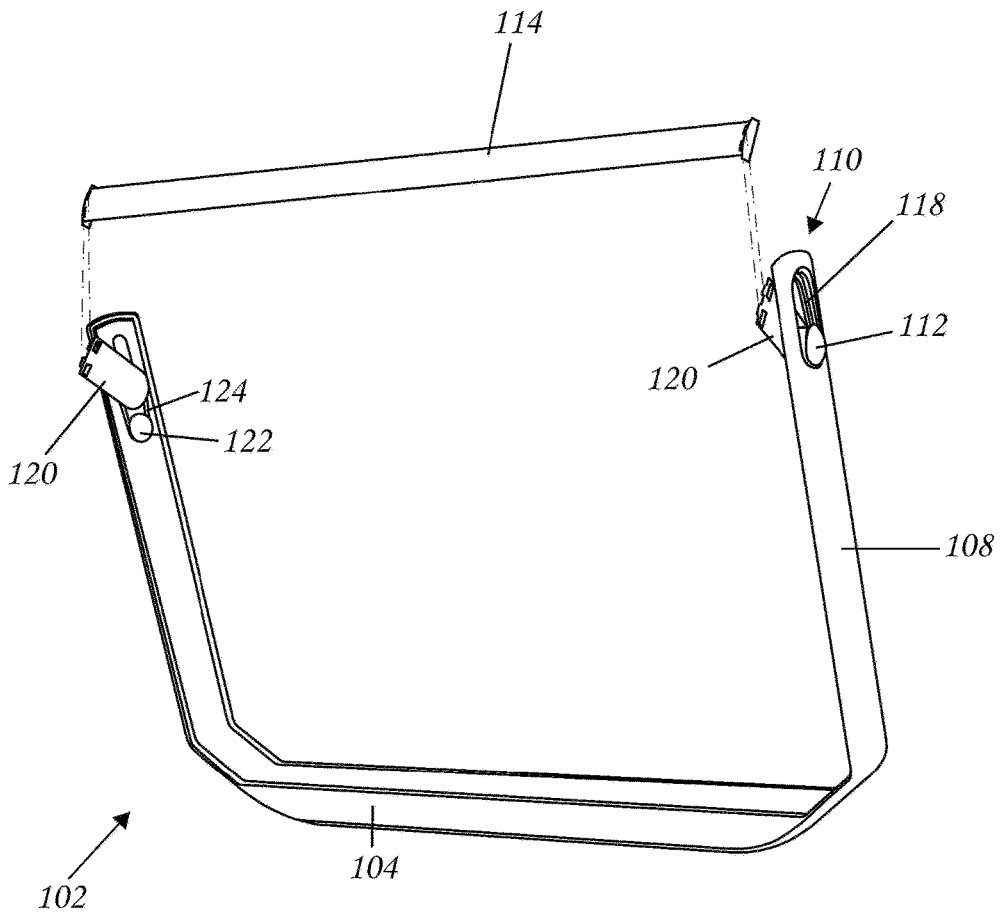
FIG. 2 is a perspective view depicting the protective cover according to FIG. 1.
Figure 3:
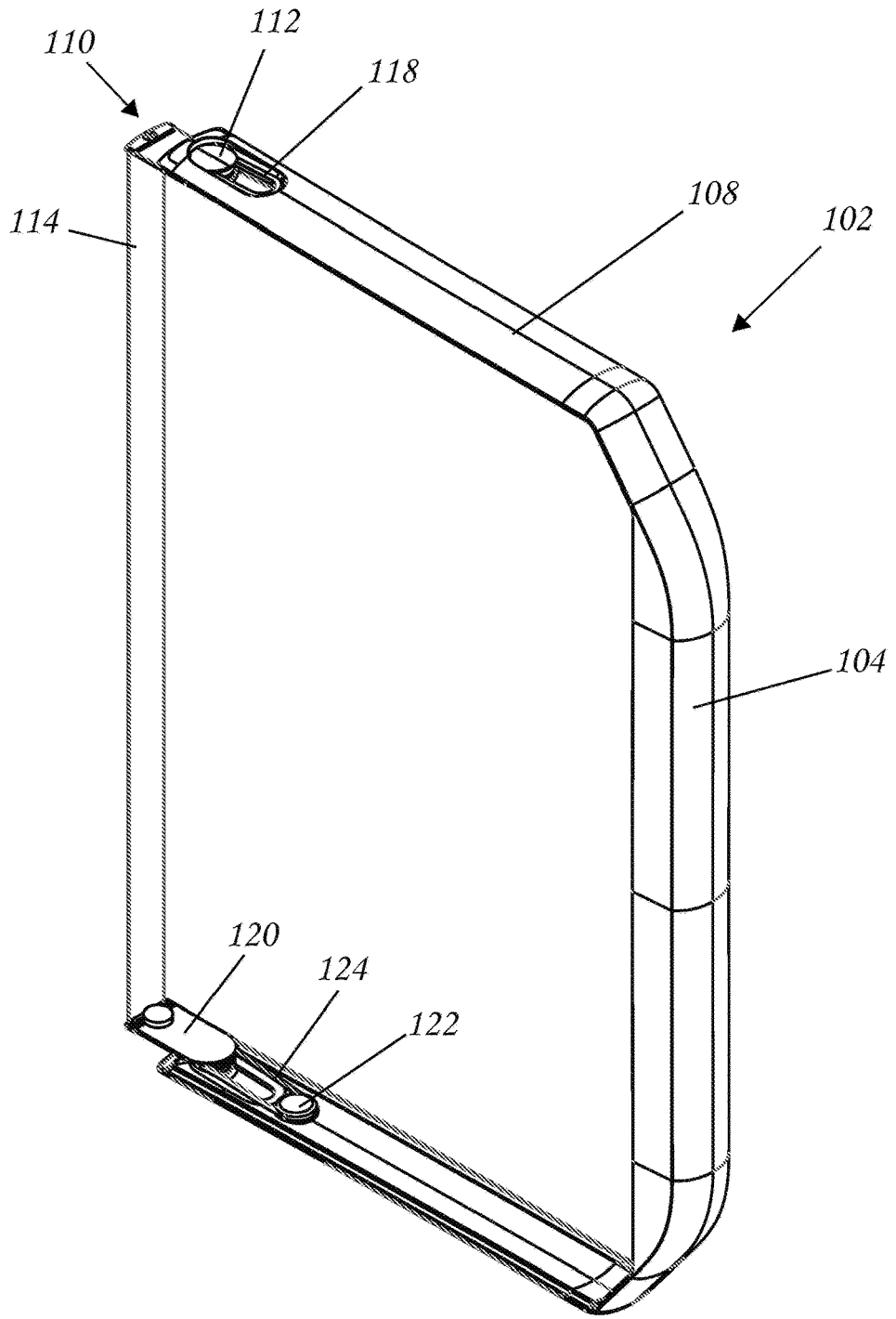
FIG. 3 is a perspective view depicting the protective cover according to FIG. 1.

FIG. 1-3 depict a protective cover 100. The protective cover 100 can, in one or more non-limiting embodiments, include an edge frame 102 and a spine insert 114. Referring to FIG. 1, a perspective view of the protective cover 100 is depicted. The edge frame 102 that can fit around the exposed edges of a bound book including hardcover and paperback books, notebooks, note pads, sketchbooks, or similar objects. The edge frame 102 can be rigid and made from plastic or metal. In some embodiments, the edge frame 102 can be flexible and made from silicon or similar materials common in the art. In one or more embodiments, the edge frame 102 can have a pull bar 104 with each end of the pull bar 104 attached to a connector arm 108. Further, the connector arms 108 can each have connector ends 110 which can have pivot tabs 120 and slide pegs 112 that allows the edge frame 102 to pivot or swing open similar to a book cover. Additionally, the edge frame 102 has a removable spine insert 114 that is fixedly attached to connector ends 110 of the connector arms 108 of the edge frame 102. In some embodiments, the spine insert 114 can be a flat and rectangular and can be inserted into the spine of a book, notebook, or sketchbook. For instance, the spine insert 114 can be inserted within the small pocket of the binding of hardcover book and secured in place by connecting the spine insert 114 to the connector arms 108 of the edge frame 102. The spine insert 114 anchors the edge frame 102 in place so that the edge frame 102 can fully cover and protect the edges of a book, notebook, sketchbook, or similar objects. In one or more embodiments, the protective cover 100 can have protective panels (not shown) with inserts to insert the cover of a bound book, including hardcover and paperback books, notebooks, sketchbooks, and sketch pads.

In one or more embodiments, the pull bar 104 can be hollow with a compartment 116 for storage. The storage compartment 116 can hold various items such as pencils, pens, paint brushes, precision knives, and similar items. In other embodiments, the pull bar 104 can be made of one, thick, solid piece of material with no interior compartment. One can pull the pull bar 104 away from the edge of a book to unlock the edge frame 102 so that the edge frame 102 may swing freely and subsequently, the book may be opened.

In one or more embodiments, each connector end 110 of the connector arms 108 can have slide pegs 112 and pivot tabs 120. The pivot tabs 120 can be fixed attached to the spine insert 114 and remain stationary once fixedly attached to the spine insert 114. The slide peg 112, which is attached to the pivot tab 120, also remains stationary when a pivot tab 120 is fastened to the spine insert 114. The connector end 110 can also define an extended aperture 118 that allows the edge frame 102 to move from its open configuration to its closed configuration. The extended aperture 118 allows movement of the edge frame 102 towards and away from the book edges, but also can allow an open and close movement about the slide peg 112 along the circumference of the slide peg 112, similar to opening and closing a book. Additionally, a spring housing 122 can be attached underneath the surface of the connector end 110 to hold a spring band 124. In some embodiments, the spring band 124 may be an elastic band or a metal coil loop. The spring band 124 can be stretched to wrap around the spring housing 122 and the slide peg 112 to create resistance, such that the spring band 124 is stretched when the edge frame 102 is disengaged, and contracted when the edge frame 102 is engaged and covering the edges of a book, notebook, or sketchbook.

Referring now to FIG. 2, a perspective view of the protective cover 100 according to FIG. 1 is depicted. The edge frame 102 can be fastened to the spine insert 114, which can be inserted into the spine or binding of a bound book including hardcover and paperback books, a notebook, or sketchpad. The edge frame 102 can be secured against the exposed edges of the book, notebook, or sketchpad and held in place once the edge frame's 102 pivot tabs 120 are fastened to the spine insert 114. Each pivot tab 120 can be attached to a slide peg 112 and fastened to the connector arm 108 by pushing the slide pin through an extended aperture 118 defined by the connector end 110 of a connector arm 108 of the edge frame 102. When the protective cover 100 is in an unlocked position, the edge frame 102 can freely pivot or rotate around each slide peg 112 such that the connector arm 108 is no longer aligned with the pivot tabs 120. When the protective cover 100 is engaged and secured into position in its closed configuration, the edges of a book are completely covered because the edge frame 102 and the edges of the cover of a book or similar item form a seal to prevent damage to the pages of the book. Additionally, the edge frame 102 does not rotate in this closed configuration.

Referring now to FIG. 3, a perspective view of the protective cover 100 according to FIG. 1 is depicted. The protective cover 100 can have an open or unlocked position such that a user may pull the pull bar 104 away from the book edge outwardly, which creates a gap between the book edge and the pull bar 104. In this position, the edge frame 102 may swing open like the cover of a book. In some embodiments in which the pull bar 104 has a compartment (not shown), the compartment would be inaccessible when the edge frame 102 is fully engaged and the pull bar 104 is pushed against the book edge. In other words, the contents of the compartment will be secured within the compartment. In one or more embodiments, each connector end 110 of the connector arms 108 can have slide pegs 112 and pivot tabs 120. The pivot tabs 120 can be fastened to the spine insert 114 and remain stationary once fastened to the spine insert 114 and when the protective cover 100 is in its closed configuration. The slide peg 112, which is attached to the pivot tab 120, also remains stationary when a pivot tab 120 is fastened to the spine insert 114. The connector end 110 can also define an extended aperture 118 that allows the edge frame 102 to move from its open configuration to its closed configuration. The slide pegs 112 which sit within the extended apertures 118 allow movement of the edge frame 102 towards and away from the book edges, but also can allow rotation about the slide peg 112, similar to opening and closing a book. Additionally, a spring housing 122 can be attached underneath the surface of the connector end 110 to hold a spring band 124. In some embodiments, the spring band 124 may be an elastic band. In other embodiments, the spring band 124 may be a metal coil loop. The spring band 124 can be wrapped around the spring housing 122 and the slide peg 112 to create resistance, such that the spring band 124 is stretched when the edge frame 102 is disengaged and the protective cover 100 is in its unlocked position, and contracted when the edge frame 102 is engaged and covering the edges of a bound book such as a hardcover or paperback book, notebook, or sketchbook.

Figure 4:
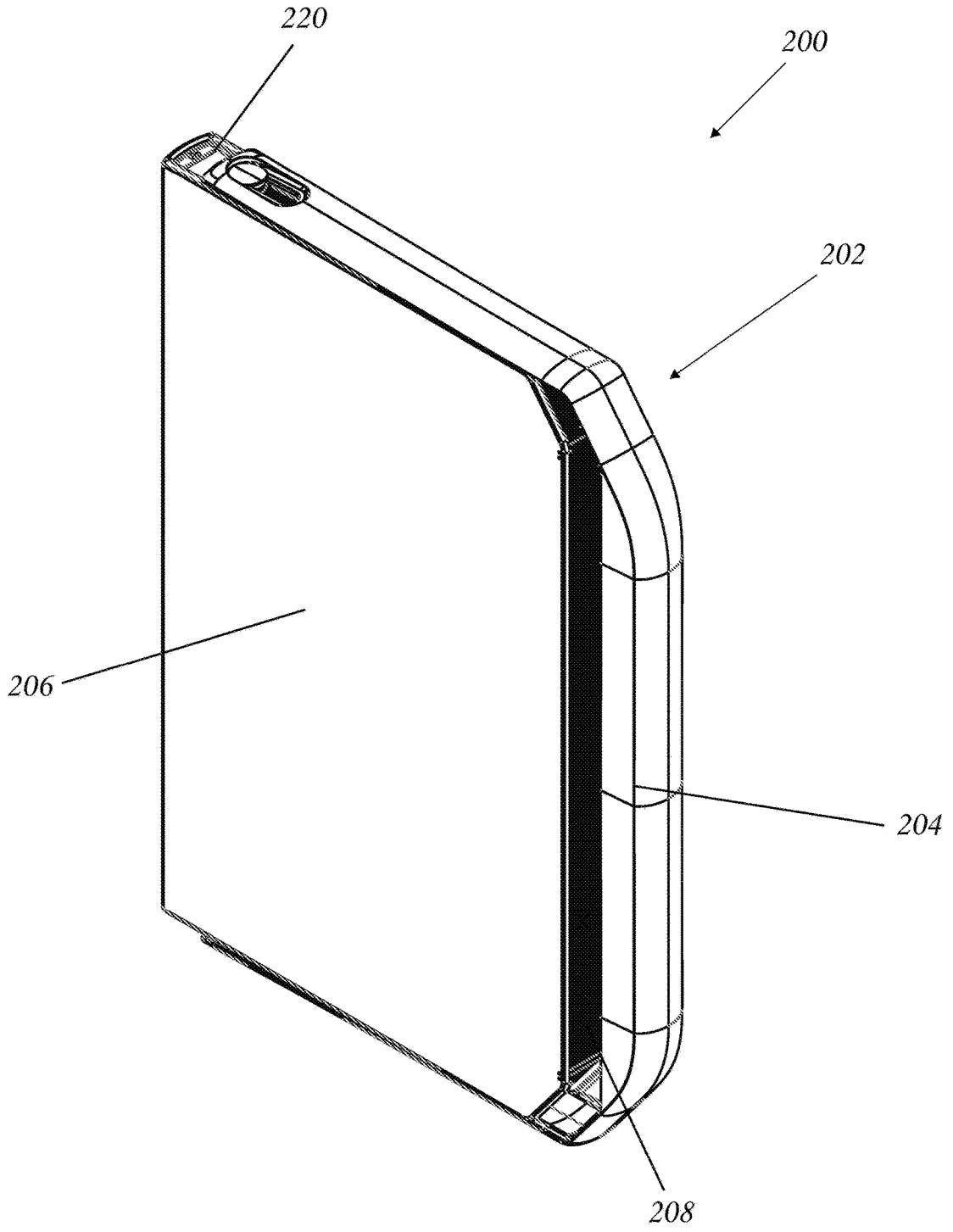
FIG. 4 is a perspective view depicting the protective cover according to one embodiment.

Referring now to FIG. 4, a perspective view of the protective cover 200 is depicted according to one or more embodiments. The protective cover 200 can have an edge frame 202 with a pull bar 204 and a plurality of cover panels 206 to provide additional protection for the actual covers of a bound book, including hardcover and paperback books, notebooks, and sketch books. The edge frame 202 can have pivot tabs 220 that can be fastened to a spine insert (not shown). Also, the edge frame 202 can be disengaged or unlocked by pulling the pull bar 204 away from the edges of a bound book, which exposes the edges of the bound book as well as exposes the pivot tabs 220. Once the edge frame 202 is unlocked, the entire edge frame 202 as well as the cover panels 206 can be opened like opening a book. In some embodiments, the cover panels 220 can be made from rigid plastic or metal. In other embodiments, the cover panels 220 can be made from flexible material such as silicon.

While alternate embodiments have been illustrated and described, as noted above, many changes can be made without departing from the spirit and scope of the RIGID PROTECTION COVER AND CLOSURE. Accordingly, the scope of the RIGID PROTECTION COVER AND CLOSURE not limited by the disclosure of these preferred and alternate embodiments. Instead, the scope of the invention title be determined entirely by reference to the claims. Insofar as the description above and the accompanying drawings (if any) disclose any additional subject matter that is not within the scope of the claims below, the inventions are not dedicated to the public and Applicant hereby reserves the right to file one or more applications to claim such additional inventions.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract, and drawings) may be replaced by alternative features serving the same, equivalent, or similar purpose, unless expressly stated otherwise.

Thus, unless expressly stated otherwise, each feature disclosed is one example of a generic series of equivalent or similar features.

Any element in a claim that does not explicitly state "means for" performing a specified function, or "step for" performing a specific function is not to be interpreted as a "means" or "step" clause as specified in 35. U.S.C. § 112 ¶6. In particular, the use of "step of" in the claims herein is not intended to invoke the provisions of U.S.C. § 112 ¶6.

What is claimed is:

1. A protective cover, comprising:

an edge frame comprising a pull bar and a plurality of connector arms; and a spine insert;

wherein each of said plurality of connector arms comprise a connector end;

wherein each connector end defines an extended aperture;

wherein each connector end comprises a pivot tab, a slide peg, a spring housing, and a spring band;

wherein said pivot tab is attached to said slide peg;

wherein said slide peg is inserted within said extended aperture;

wherein said spring housing is attached to one of said connector ends;

wherein said pivot tab is fastened to said spine insert.

2. The protective cover of claim 1, wherein the pull bar comprises a storage compartment.

3. The protective cover of claim 1, wherein the edge frame further comprises rigid plastic.

4. The protective cover of claim 1, wherein the spine insert further comprises rigid plastic.

5. The protective cover of claim 1, wherein the edge frame further comprises metal.

6. The protective cover of claim 1, wherein the spine insert further comprises metal.

7. The protective cover of claim 1, wherein the edge frame further comprises silicon.

8. The protective cover of claim 1, wherein the spine insert further comprises silicon.

9. The protective cover of claim 1, further comprising a plurality of cover panels.

10. The protective cover of claim 7, wherein the plurality of cover panels further comprise rigid plastic.

11. The protective cover of claim 7, wherein the plurality of cover panels further comprise metal.

12. The protective cover of claim 7, wherein the plurality of cover panels further comprise silicon.

* * * * *